US005890301A

United States Patent [19]

Marschke

[11] Patent Number: 5,890,301

[45] Date of Patent: Apr. 6, 1999

[54] THREAD-UP APPARATUS FOR A CORRUGATOR DOUBLE BACKER

[75] Inventor: Carl R. Marschke, Phillips, Wis.

[73] Assignee: Marquip, Inc., Phillips, Wis.

[21] Appl. No.: 967,446

[22] Filed: Nov. 11, 1997

[51] Int. Cl.[6] ..... F26B 9/00

[52] U.S. Cl. ..... 34/625; 34/631; 34/635

[58] Field of Search ..... 34/625, 266, 629, 34/631, 635, 637, 645; 156/470, 497, 580, 583.3; 100/211, 154, 306, 309; 226/95, 170

[56] References Cited

U.S. PATENT DOCUMENTS

| | | | |
|---|---|---|---|
| 3,103,755 | 9/1963 | Hajos | 34/629 |
| 3,319,353 | 5/1967 | Matsunami et al. | 34/634 |
| 5,256,240 | 10/1993 | Shortt | 156/470 |
| 5,456,783 | 10/1995 | Sissons | 156/470 |
| 5,561,918 | 10/1996 | Marschke | 34/629 |
| 5,706,994 | 1/1998 | Welch et al. | 226/95 |
| 5,746,010 | 5/1998 | Marschke et al. | 34/631 |
| 5,766,409 | 6/1998 | Krznarich et al. | 156/470 |

*Primary Examiner*—Henry Bennett
*Assistant Examiner*—Steve Gravini
*Attorney, Agent, or Firm*—Andrus, Sceales, Starke & Sawall

[57] ABSTRACT

A web thread-up apparatus for a beltless double backer includes a coiled flexible band positioned at the downstream end of the double backer on a reel from which the band may be unwound in the upstream direction through the double backer heating section. A clamping device on the free end of the band is utilized to capture the downstream edge of a new corrugated web positioned at the upstream entry to the double backer. Rotation of the reel is reversed to rewind the flexible band into the coil, carrying the web with it through the heating section of the double backer. A downstream web drive conveyor receives the lead edge of the new web which is detached from the rewound clamping device.

12 Claims, 2 Drawing Sheets

THREAD-UP APPARATUS FOR A CORRUGATOR DOUBLE BACKER

BACKGROUND OF THE INVENTION

The present invention relates to a corrugating system for the manufacture of a corrugated paperboard web and, more particularly,, to a thread-up apparatus particularly useful in a corrugator double backer utilizing a beltless holddown system.

In the past, a corrugator double backer has typically utilized a wide driven holddown belt to carry the double face corrugated web over the flat heated surface of the heating section and to simultaneously provide a holddown load on the upper web surface to enhance curing of the adhesive joining the second liner web to the previously formed single face web. The driven holddown belt is also utilized to provide initial thread-up of the downstream end of a freshly glued double face web.

The advent of the beltless double backer, as described for example in co-pending U.S. application Ser. No. 08/643,627, filed May 6, 1996, has resulted in much improved double backer performance with a much simpler construction. However, the elimination of a driven holddown belt has also eliminated the common means for threading a new web into and through the double backer. Thread-up of a new web may be accomplished by hand, but it is a cumbersome procedure and must be undertaken in a typically warm and uncomfortable environment. Thus, a thread-up device for a beltless double backer would be very useful, but such a device would have to withstand the high temperature environment and would have to be located in very limited confines where it would not interfere with double backer operation. The thread-up apparatus would also have to operate in conjunction with the holddown mat lift system of the type disclosed in the above identified application.

SUMMARY OF THE INVENTION

In accordance with the present invention a thread-up apparatus for pulling a paper web over a level surface in a corrugator broadly comprises a flexible band which is adapted to be wound into a coil and positioned downstream of the surface, an unwinder for unwinding the band from the coil to extend the band in the upstream direction over the surface and to carry the free end of the band to the upstream end of said surface, a web clamping device on the free end of the band which is adapted to receive and detachably clamp the end of the web, and a rewinder for rewinding the band into the coil and pulling the web therewith over said surface. Preferably, the surface comprises a heating surface in a corrugator double backer and the web comprises a double face corrugated web.

More specifically, the present invention is directed to an apparatus for pulling a corrugated paperboard web over the heating surface which defines the heating section of a double backer to provide initial web thread-up, the apparatus comprising a flexible band which is adapted to be wound into a coil and positioned downstream of the heating section, an unwinder for unwinding the band from the coil to extend the band upstream over the heating surface and to carry the free end of the band to the upstream end of the heating section, a web clamping device on the free end of the band adapted to receive and detachably clamp the end of the web, and a rewinder for rewinding the band into the coil and for pulling the web therewith through the heating section. The band is preferably made of metal and, more particularly, is made of a spring steel sheet. The spring steel sheet is preferably about 0.030 inch in thickness.

The thread-up apparatus of the present invention is preferably used with a double backer of the type including a passive web holddown apparatus which is adapted to overlie and to rest upon a paperboard web, and further includes a lift mechanism operative to raise the holddown apparatus for thread-up and to provide an open space over the heating surface for operation of the thread-up apparatus.

In the preferred embodiment of the invention, the web clamping device comprises a web clutching mechanism which is responsive to relative movement of said band into engagement with the web end to receive the web end therein, and said clutching mechanism is responsive to reverse downstream movement of the band to clamp the web end therein. More specifically, the clutching mechanism comprises a wedge-shaped nose which is adapted to slide under the web and in response to said relative movement, and a plurality of rotatable dogs which are positioned above the nose and have web-engaging lower ends rotatable freely in one direction in response to engagement by the web end and restricted against rotation in the other direction in response to said reverse downstream movement.

In one particularly preferred embodiment, the present invention is utilized in a beltless double backer apparatus which provides an adjustable holddown force on the upper surface of a laminated paperboard web traveling over a flat-supporting heating surface, where the double backer apparatus comprises a flexible mat which extends over the web in the direction of web travel between upstream and downstream mat ends, the mat providing a load directly to the web; a lift device which includes upstream and downstream mat supports and which is operative to move the respective mat ends generally vertically with respect to the web to vary the length of the mat resting upon the web and to lift the mat from the heating surface for initial web thread-up; a coiled thread-up band which is positioned downstream of the heating section; a coil winder which is operative to unwind the band in the upstream direction over the heating surface, and to rewind the band to the coiled downstream position; and a web clamping device on the free end of the band which is operative to clamp the end of the web in the upstream position of the band to pull the web over the heating surface to the downstream position of the band.

The thread-up apparatus of the present invention is also particularly adaptable for use in a beltless double backer which includes a web drive device positioned downstream of the heating surface and which is operative to drivingly engage the web to pull the web over the surface. The web thread-up device includes a flexible band which is dispensable from a band storage adjacent the web drive device and is operative to extend the band upstream over the heating surface. The band has a free clamping end which is adapted to receive and detachably clamp the end of the web at a location upstream of the heating surface, and the thread-up device further includes a rewinder for returning the band to the band storage and for carrying the web end into driving engagement with the web drive device. The web drive device preferably comprises a vacuum conveyor.

DETAILED DESCRIPTION OF THE PREFERRED EMBODIMENT

Figure 1:
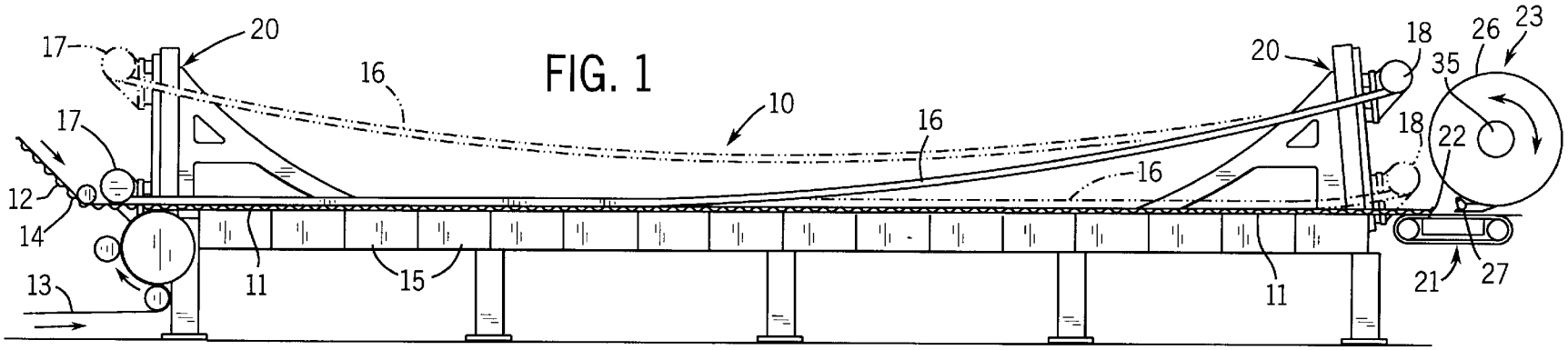
FIG. 1 is a side elevation of a corrugator double backer including a thread-up apparatus of the subject invention with the double backer shown in its operative web conditioning position and the thread-up apparatus of the subject invention in its inoperative position.

In FIG. 1, there is shown a double backer 10 in which a double face corrugated web 11 is formed by joining a single face corrugated web 12 and a liner web 13. The glue tips of the corrugated medium 14 of the single face web are covered with a starch-based adhesive in an upstream glue machine (not shown) and the adhesive bond between the glued tips and the liner 13 is cured by the application of heat and pressure as the freshly glued double face web 11 is pulled through the double backer 10.

Heat is applied by a series of heating units 15 having flat, coplanar heating surfaces over which the double face web 11 travels through the double backer. The heating units traditionally comprise individual steam chests which are fabricated of a heavy-walled cast iron or steel construction, but may also comprise any suitable flat web-supporting surface. Each steam chest has an open interior to which high pressure steam is supplied, in a known manner, utilizing a supply system which is not shown in the drawings. Each heating unit 15 may be 18–24 inches (about 45–60 cm) in length (in the direction of web movement) and have a width in the cross machine direction sufficient to fully support the maximum width of corrugated web to be processed, e.g. 96 inches (or about 245 cm). The total length of the heating section provided by a series of heating units may be, for example, 30–40 feet (about 9–12 m).

The double backer 10 is of a type commonly referred to as a beltless double backer because of its elimination of the well known driven holddown belt characteristic of prior art double backers. In lieu of a holddown belt, the double backer 10 includes a flexible weighted blanket or holddown mat 16 which is supported between upstream and downstream mat supports 17 and 18 over the heating section. The mat supports 17 and 18 are adjustable vertically on respective lift devices 20 to bring a selectively variable length of the holddown mat 16 onto the top of the double face web 11 moving over the flat heating surface provided by the heating units 15. A downstream web drive mechanism, such as a vacuum conveyor 21, pulls the web through the double backer between the heating units 15 and the holddown mat 16. The vacuum conveyor performs the web drive function traditionally provided by a driven holddown belt.

Figure 2:
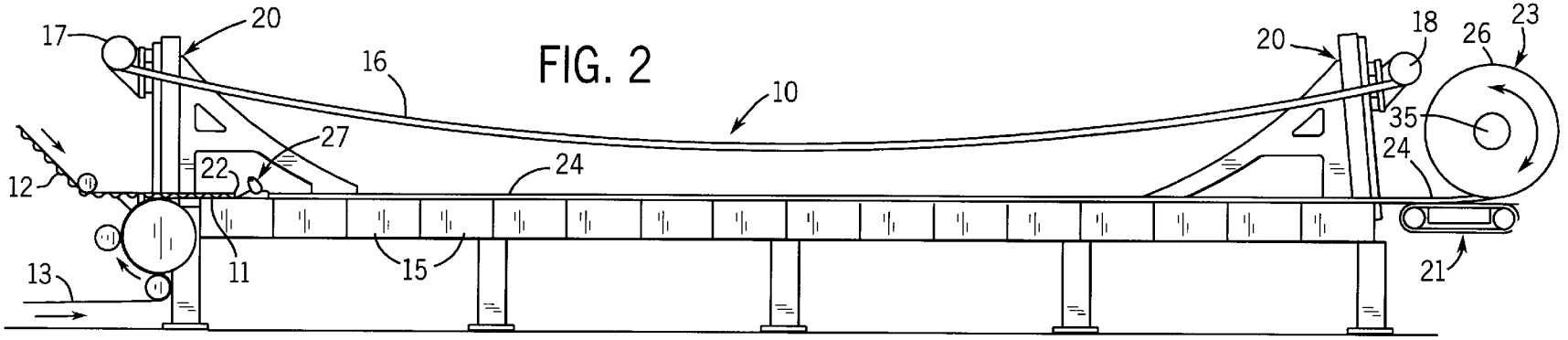
FIG. 2 is a side elevation similar to FIG. 1 showing the double backer in its inoperative position and the thread-up apparatus fully deployed.

However, in the prior art, a holddown belt also is utilized to provide initial thread-up of the double backer at the time of system start-up or to accommodate an order change necessitating a web change. Referring also to FIG. 2, the lead edge 22 of a new double face web 11 is shown at the upstream end of the double backer 10 in a position to be "threaded" through the heating section and into operative engagement with the downstream vacuum conveyor 21. To facilitate thread-up, the mat supports 17 and 18 are moved vertically upwardly to lift the holddown mat 16 from the heating surface of the heating units 15 to provide space for movement of the web through the heating section.

Figure 4:
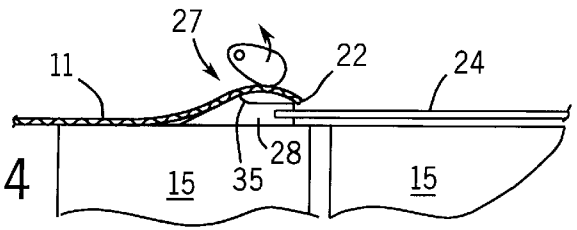
FIGS. 3 and 4 are enlarged details of a portion of FIG. 2 showing operation of the web clamping device on the thread-up apparatus.
Figure 3:
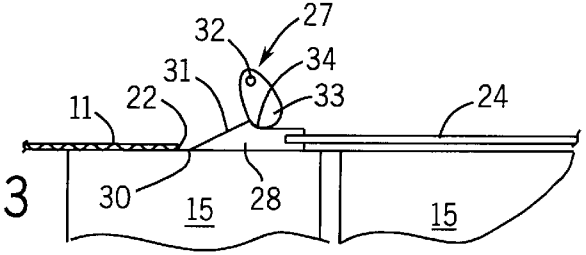
Figure 5:
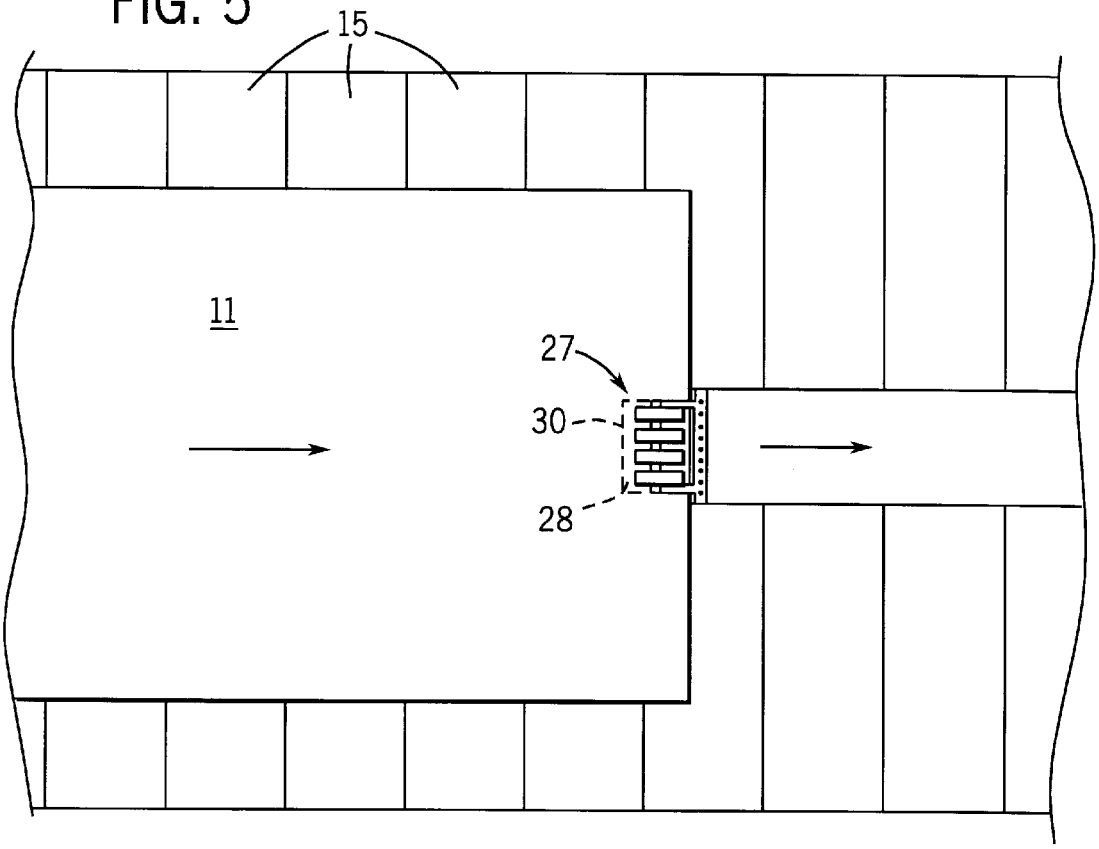
FIG. 5 is a top plan view of FIG. 4.

Referring also to FIGS. 3–5, a thread-up apparatus 23 of the present invention comprises a flexible band 24 which is wound into a coil 25 on a downstream reel 26. The band 24 is deployed in the upstream direction from the coil to extend through the double backer heating section and has a clamping device 27 on its free upstream end to clamp the lead edge 22 of the web 11. The coil 25 is then rewound on the reel 26 to pull the band and the attached web through the double backer heating section to bring the web lead edge 22 into operative engagement with the vacuum conveyor 21. Thereafter, continuous web movement through the double backer is provided by the vacuum conveyor, and the holddown mat 16 may be lowered into engagement with the running web by operation of one or both of the mat supports 17 and 18.

The flexible thread-up band 24 preferably comprises a sheet of spring steel of a length somewhat greater than the length of the double backer heating section. The steel band 24 may have a width of about 24 inches (about 60 cm) and a thickness of 0.030 inch (about 0.8 mm). The band 24 must be sufficiently stiff so that it may be unwound from the coil 25 and pushed upstream through the heating section without buckling. On the other hand, the band must be flexible enough to allow it to be re-wound into the coil.

The clamping device 27 includes a wedge-shaped nose 28 attached to the free end of the band 24 and extending approximately the full width thereof. The nose 28 has a narrow upstream edge 30 and an upwardly sloping ramp surface 31. The nose 28 may be constructed of any suitable material, but the ramp surface 31 is preferably made of or covered with a high friction rubber or plastic material. Suspended above the nose 28 is a horizontally disposed rotatable shaft 32 to which are secured a plurality of aligned, laterally spaced dogs 33. The shaft 32 is positioned above the nose 28 a distance less than the length of a dog 33 so that the shaft 32 and attached dogs 33 are free to rotate in the downstream direction, but are limited to rotation in the upstream direction by contact between the dogs 33 and the upper surface of the nose 28. In particular, the upper surface of the nose 28, at the upper terminus of the ramp surface 31, is provided with a recess 34 which acts as a stop to restrict upstream rotation of the dogs 33. The recess 34 is also preferably made of or provided with a high friction surface.

Referring particularly to FIGS. 3 and 4, as the flexible band 24 is unwound from its coil 25 on the downstream reel 26, the clamping device 27 moves over the heated surface of the heating units 15 until it engages the lead edge 22 of the new double face web 11 to be threaded through the double backer. Relative horizontal movement in opposite directions between the band and the web will cause the lead edge 22 of the web to ride up the ramp surface 31, engage the dogs 33 causing them to rotate upwardly (counterclockwise in FIG. 4), and allow the web to pass thereunder. The dogs 33 have weighted free ends which are also provided with a high friction outer surface where they engage the web 11. Rotation of the reel 26 is then reversed to rewind the band 24 in the downstream direction into the coil 25 on reel 26. In response to this reverse horizontal movement of the band, the weight of the dogs 33 and the barrier provided by the recess 34 restricting upstream rotational movement, causes the lead edge 22 of the web to be clutched between the dogs and the nose 28 and, therefore, to be carried with the band 24 through the heating section as the band is rewound. It should be noted that the lead edge 22 of the web may also be manually inserted into the clamping device 27 to place it in position to be clutched by the device when the band is rewound as indicated.

Figure 6:
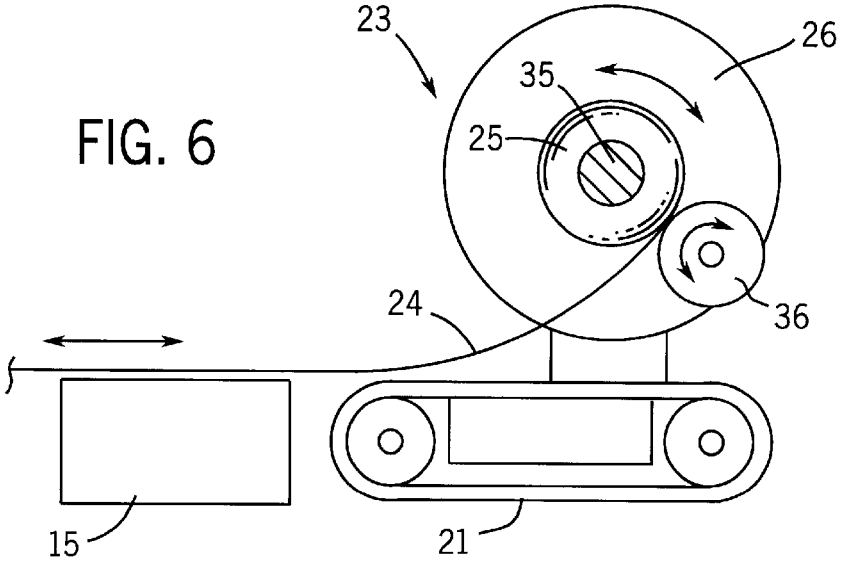
FIG. 6 is an enlarged side elevation detail of a portion of FIG. 2.

The reel 26 may be motor driven or rotated manually to unwind and rewind the flexible band 24. Referring to FIG. 6, the reel 26 is mounted on a rotatable reel shaft 35 which may be motor driven or supported for free idling rotation. A rubber pressure roll 36 is mounted to engage the coil 25 and is spring biased to maintain engagement with the coil as its diameter varies as a result of unwinding and rewinding. The pressure roll may alternately be motor-driven or simply operated as a idling pressure roll. Preferably, the pressure roll 36 is driven in the counterclockwise direction to cause the band to be unwound and deployed from the coil and the reel shaft is motor-driven in the counterclockwise direction to rewind the band into the coil 25. The bias of the pressure roll 36 against the coil 25 assists in maintaining a relatively tightly wound coil, as well as suitable frictional engagement if the roll is also driven. During rewind, when the clamping device 27 and the web lead edge 22 reach the vacuum conveyor 21, the web end may be manually released from the clamping device 27. Alternately, a suitable stationary contact device in the path of the clamping device 27 may be positioned to be engaged by a detent attached to the rotatable dog shaft 32 to cause upward counterclockwise rotation thereof to release the web.

I claim:

1. An apparatus for pulling a paper web over a level surface to provide initial web thread-up, said apparatus comprising:

a flexible band adapted to be wound into a coil and positioned downstream of the surface;

an unwinder for unwinding the band from the coil to extend the band upstream over the surface and to carry the free end of the band to the upstream end of the surface;

a web clamping device on the free end of the band adapted to receive and detachably clamp the end of the web; and, a rewinder for rewinding the band into the coil and pulling the web therewith over said surface.

2. The apparatus as set forth in claim 1 wherein said surface comprises a heating surface in a double backer and the web comprises a double face corrugated web.

3. An apparatus for pulling a corrugated paperboard web over the heating surface defining the heating section of a double backer to provide initial web thread-up, said apparatus comprising:

a flexible band adapted to be wound into a coil and positioned downstream of the surface;

an unwinder for unwinding the band from the coil to extend the band upstream over the heating surface and to carry the free end of the band to the upstream end of the heating section;

a web clamping device on the free end of the band adapted to receive and detachably clamp the end of the web; and, a rewinder for rewinding the band into the coil and pulling the web therewith through the heating section.

4. The apparatus as set forth in claim 3 wherein said band is made of metal.

5. The apparatus as set forth in claim 4 wherein said band comprises a sheet of spring steel.

6. The apparatus as set forth in claim 5 wherein said band is approximately 0.030 inch (about 0.8 mm) thick.

7. The apparatus as set forth in claim 3 wherein said double backer includes a passive web holddown apparatus adapted to overlie and to rest upon the paperboard web; and a lift mechanism operative to raise the holddown apparatus for thread-up and to provide an open space over the heating surface for operation of said thread-up apparatus.

8. The apparatus as set forth in claim 3 wherein said web clamping device comprises:

a web clutching mechanism responsive to relative movement of said band into engagement with the web end to receive said web end therein; and, said clutching mechanism operative in response to reverse downstream movement of said band to clamp the web end therein.

9. The apparatus as set forth in claim 8 wherein said clutching mechanism comprises:

a wedge-shaped nose adapted to slide under the web and in response to said relative movement; and, a plurality of rotatable dogs positioned above said nose and having web-engaging lower ends rotatable freely in one direction in response to engagement by the web end and restricted against rotation in the other direction in response to said reverse downstream movement.

10. A double backer apparatus for providing an adjustable holddown force on the upper surface of a laminated paperboard web traveling over a flat web-supporting heating surface, said apparatus comprising:

a flexible mat extending over the web in the direction of web travel between upstream and downstream ends, said mat providing a load directly to the web;

a lift device including upstream and downstream mat supports operative to move said respective mat ends generally vertically with respect to the web to vary the length of the mat resting upon the web and to lift the mat from the heating surface for initial web thread-up;

a coiled thread-up band positioned downstream of the heating section;

is a coil winder operative to unwind the band in the upstream direction over the heating surface and to rewind said band to the coiled downstream position; and, a web clamping device on the free end of the band operative to clamp the end of the web in the upstream position of the band and to pull the web over the heating surface to the downstream position of the band.

11. A double backer apparatus for providing an adjustable holddown force on the upper surface of a laminated paperboard web traveling over a flat web-supporting heating surface, said apparatus comprising:

a web drive device downstream of said heating surface operative to drivingly engage the web to pull the web over said surface;

a flexible mat extending over the web in the direction of web travel between upstream and downstream ends, said mat providing a load directly to the web;

a lift device including upstream and downstream mat supports operative to move said respective mat ends generally vertically with respect to the web to vary the length of the mat resting upon the web and to lift the mat from the heating surface for initial web thread-up;

a web thread-up device including a flexible band dispensable from a band storage adjacent said web drive device to extend the band upstream over said heating surface;

said band having a free clamping end adapted to receive and detachably clamp the end of the web at a location upstream of said heating surface; and, said thread-up device including a rewinder for returning said band to said band storage and for carrying the web end into driving engagement with said web drive device.

12. The apparatus as set forth in claim 11 wherein said web drive device comprises a vacuum conveyor.

* * * * *